United States Patent [19]

Tobin et al.

[11] Patent Number: 4,549,739

[45] Date of Patent: Oct. 29, 1985

[54] GAME APPARATUS FOR USE IN BACKGAMMON-LIKE GAMES

[76] Inventors: Patrick L. Tobin, 654 Malarin Ave., Santa Clara, Calif. 95050; Joseph W. Green, #1, 5570 Clover Crest Dr., San Jose, Calif. 95118; John A. Lerohl, 6740 Altiplano Way, San Jose, Calif. 95119

[21] Appl. No.: 466,502

[22] Filed: Feb. 15, 1983

[51] Int. Cl.[4] ..... A63F 3/00

[52] U.S. Cl. ..... 273/248

[58] Field of Search ..... 273/248, 249, 260, 261, 273/258; D21/34, 15, 24

[56] References Cited

U.S. PATENT DOCUMENTS

| | | | |
|---|---|---|---|
| D. 84,477 | 6/1931 | Hirtenstein | D21/34 |
| D. 85,066 | 9/1931 | Sternau | D21/34 |
| D. 97,078 | 10/1935 | Lord | D21/33 |
| D. 160,525 | 10/1950 | Othon | D21/33 |
| D. 256,594 | 8/1980 | Tawil | D21/15 |
| D. 260,661 | 9/1981 | Thomas et al. | D21/34 |
| D. 261,284 | 10/1981 | Thomas et al. | D21/34 |
| D. 265,215 | 6/1982 | Rosen | D21/34 |
| D. 267,499 | 1/1983 | Cooper | D21/15 |
| 1,116,650 | 11/1914 | Waindle | 273/258 |
| 1,362,218 | 12/1920 | Beloin | 273/249 |
| 2,995,374 | 8/1961 | Deatherage | 273/248 |
| 3,395,922 | 8/1968 | Garangiotis | 273/248 |
| 4,058,319 | 11/1977 | Thomas et al. | 273/134 AD |
| 4,124,212 | 11/1978 | Normart | 273/248 |
| 4,211,419 | 7/1980 | Larsen | 273/248 |
| 4,286,787 | 9/1981 | Barber | 273/248 |
| 4,342,458 | 8/1982 | Lane et al. | 273/248 |

*Primary Examiner*—Richard C. Pinkham
*Assistant Examiner*—Matthew L. Schneider
*Attorney, Agent, or Firm*—Allston L. Jones

[57] ABSTRACT

A backgammon board game for two, three or four players wherein the movement spaces are positioned in the form of a cross. Each of the players is given 15 stones which they must move around the board according to rules which are similar to those used in conventional backgammon. The stones of each player are of a color different from the stones of the other players.

2 Claims, 6 Drawing Figures

GAME APPARATUS FOR USE IN BACKGAMMON-LIKE GAMES

BACKGROUND OF THE INVENTION

The classical game of backgammon is designed to be played by two players, or it can be varied to be played by four as two, two member teams. Several inventors such as Normart in U.S. Pat. No. 4,124,212 issued Nov. 7, 1978, Barber in U.S. Pat. No. 4,286,787 issued Sept. 1, 1981, Thomas et al. in U.S. Pat. No. 4,058,319 issued Nov. 15, 1977 and Lane et al., U.S. Pat. No. 4,342,458 issued Aug. 3, 1982, have designated variations of the classical game for play by more than two players or teams. However, each of these games is either designed to be played on a board which is substantially more complicated than the game of backgammon or with a substantially different degree of crowding than the classical game of backgammon when played by a full compliment of players.

SUMMARY OF THE INVENTION

The present invention makes use of a unique playing board in the shape of a cross with eight segments each with six points with two of those segments facing each other with their points in alignment opposite each other in each arm of the cross; much like two conventional backgammon boards mounted together at right angles. Play is between two, three, or four individuals each with fifteen stones and a pair of dice using most of the rules of conventional backgammon with each player's stones going around all eight board segments. It is therefore possible to employ many of the same strategies used by players of conventional backgammon, while permitting a desirable degree of flexibility in the number of players who can participate. It is also possible for six or eight players to play as three or four two-man teams, respectively.

Using this same unique board, a series of several other unique multi-player games are also possible with each providing its own degree of challenge and excitement. The board of the present invention may also be used to play conventional backgammon between two sets of two players, each player's stones going around only four board segments, and only altered in that each player's turn rotates in a single direction amongst all of the players.

DESCRIPTION OF THE INVENTION

Figure 1:
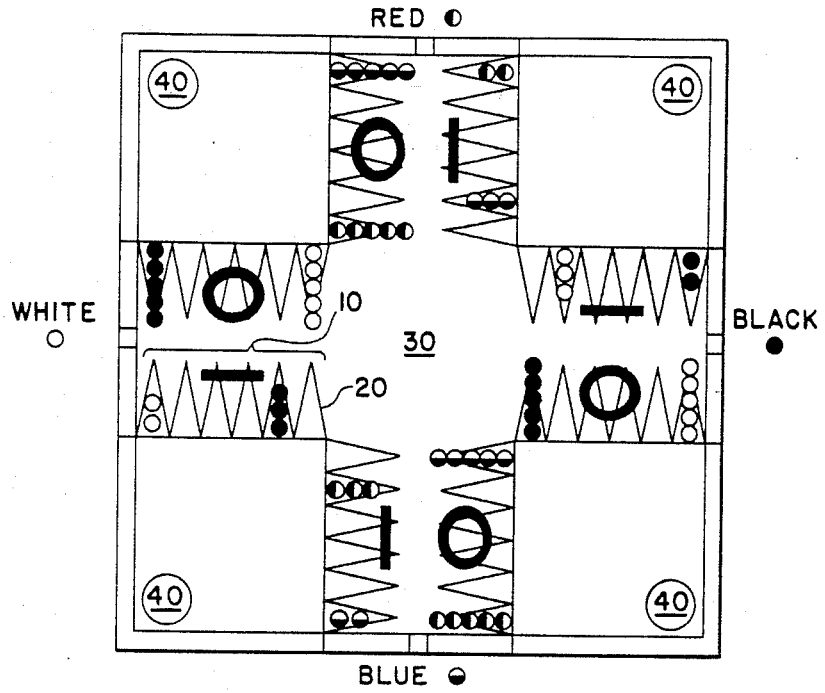
FIG. 1 shows a game board according to the present invention with the stones positioned for a first game variation referred to herein as Ultragammon TM game.
Figure 6:
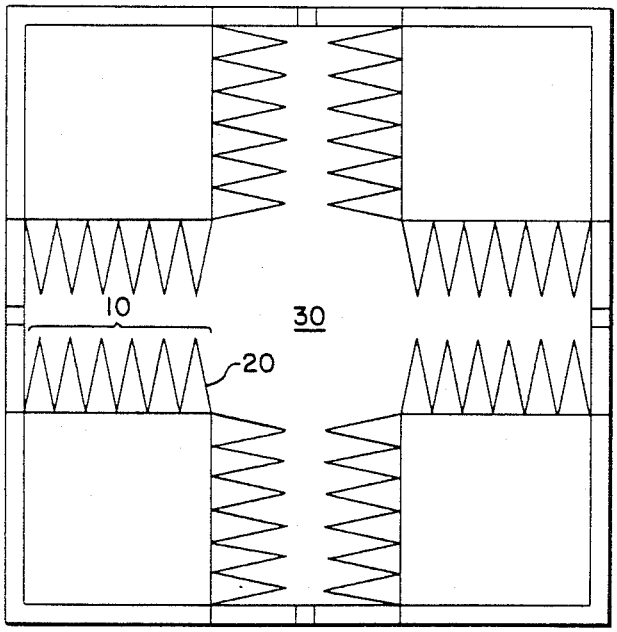
FIG. 6 shows a game board of the present invention.

FIG. 1 shows the game board of the present invention with fifteen stones of four different colors positioned for each of four players for the start of the first game variation, the Ultragammon game, according to the present invention. The board itself (FIG. 6) includes eight segments 10 of six points 20 each arranged in the shape of a cross. In each of the four arms of the cross is a pair of segments 10 facing each other with the points 10 aligned with each other. A platform 30, which is equivalent to the bar in conventional backgammon, is defined in the center of the board where the four arms of the cross connect. Four corner areas 40 are provided for holding a pair of dice for use by each player.

The game Ultragammon is an extension of Backgammon having as its object each of 2, 3, or 4 players or 4, 6 or 8 players playing as two member teams, moving each player's stones according to the number of spots shown on a pair of dice rolled by that player. Each player moves their stones from their inner table (designated with "I" in FIG. 1), around all eight segments 10, sequentially, to their outer table (designated with "O" in FIG. 1) where they bear off the stones. Each player's inner and outer tables (I and O) are opposite each other in the same arm of the cross.

To start the game, each player rolls one die. If two or more players roll the same highest number, those players must roll again until one player has rolled the highest number. That player then goes first. The players then proceed in turn in clockwise rotation, with each player's turn being initiated by his rolling of his pair of dice. A player moves his stones according to the number of spots shown on the dice. The number of spots shown on the dice are considered one at a time, not as a sum total. A player may move one stone the total number of positions shown on the two dice as long as the number of spots displayed by each die correspond to open (having no stones thereon or any number of the current player's stones thereon) or blunt (no more than one stone of an opponent) points 20. Alternately, the player may move each of two stones a number of positions each corresponding to a number of spots displayed by a different one of the dies. A player must move his stones the total number of spots on the dice whenever possible. If the positioning of all of the stones on the board permit movement of the player's stones less than the number of positions shown on the two dice, that player must, if possible, use the larger number. If any player rolls a double (the same number of spots showing on both of the dice), that player moves the number shown on one die four times (not double the number of spots shown on the two dice), then rolls again. Any point 20 on the board on which two or more stones of the same player sit is called a blocked point. An opposing player's stones may not land on a blocked point, however, they may move over the blocked point. There is no limit on the number of stones one player may have on a point 20. Any point on which a player has only one stone is a blunt point. Since stones of other players cannot occupy the same point 20, when an opponent lands on a blunt point he removes the stone that was there and blunts the point with his own stone. Such a "hit" stone is removed to the platform 30. Once one of a player's stones has been removed to the platform 30, that player must, when their next turn occurs, re-enter their stone at their inner table before moving any other stone. Entering is accomplished by moving the stone on the platform 30 to the point 20 in their inner table corresponding to the number of spots on either one of the dice rolled as long as the point is not blocked. The points 20 are counted from the edge of the board. If both points 20 corresponding to the number of spots on each die are blocked, the turn passes to the next player without the re-entry of the stone unless a double is rolled. Bearing off stones from the outer table cannot begin until all fifteen stones of any player are on the six points 20 of his outer table. A player may then either bear off stones from points 20 corresponding to the number represented by a dice roll or may move stones along the six points 20 of the outer table according to the number of spots shown on the dice. A player must always use their entire roll if possible. For example, if a player with all stones on his final six points 20 rolls a six, but has no stones on the sixth point 20 prior to the outer table, they must take a stone off the next highest point 20 which does have a stone. The game is won by the player who is first to bear off all of his stones.

Thus, as per the rules stated above, (see FIG. 1) the red and blue stones are moved clockwise from the inner table for that color to the outer table for that color. Similarly, the black and white stones are moved counterclockwise. For example, the blue stones are moved through segments 10 in the following order:

Blue Inner Table
White Inner Table
White Outer Table
Red Outer Table
Red Inner Table
Black Inner Table
Black Outer Table
Blue Outer Table while the white stones are moved through segments 10 as follows:

White Inner Table
Blue Inner Table
Blue Outer Table
Black Outer Table
Black Inner Table
Red Inner Table
Red Outer Table
White Outer Table A subvariation of the Ultragammon game is the game Warm-Up. In the game Warm-Up each player places three of their stones on the first point 20 of their inner table. Play then proceeds as in the Ultragammon game with one rule change. In the game Warm-Up, each player may bear off their stones without having all three stones in their outer table.

Figure 2:
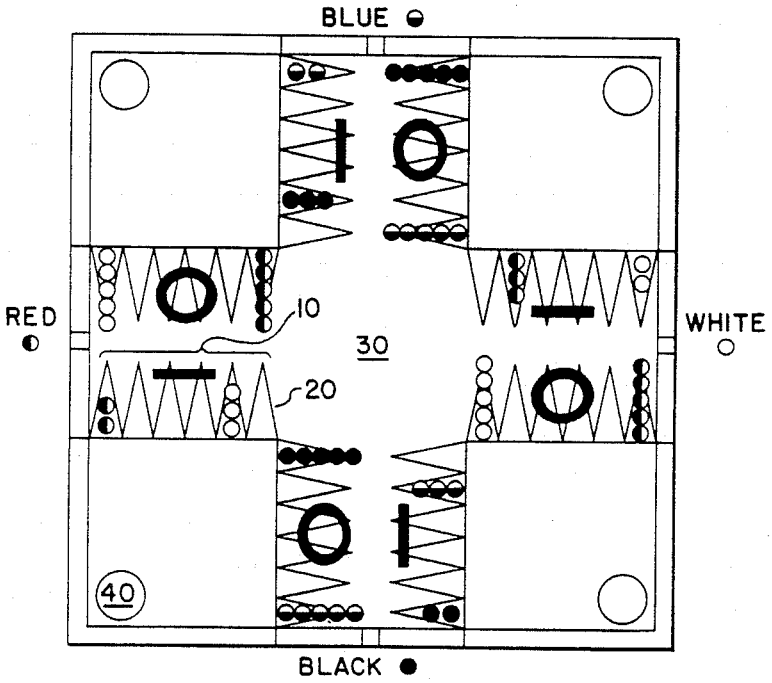
FIG. 2 shows the game board as in FIG. 1 with the stones positioned for a second game variation referred to herein as Counterclockwise TM game.

FIG. 2 shows the game board with the stones positioned for a second game variation, the Counterclockwise game. All players move their fifteen stones in a counterclockwise direction through all eight segments 10 on the board. The other rules are for the game Ultragammon. In the game Counterclockwise note that each player's inner table is on the right and their outer table is on the left.

A subvariation of the Counterclockwise game is the game Heavy Traffic. The Heavy Traffic game is played like the Counterclockwise game starting without any stones on the game board. Each stone is entered at each player's inner table with play continuing under the rules of the game Counterclockwise. The game Heavy Traffic is played with any equal number of stones for each player. The more stones used, the more challanging the play. It has been found that seven stones per player provides a challenge for the novice player, ten stones per player provides a challenge for the intermediate player, and fifteen stones per player provides a challenge for the advanced player.

Figure 3:
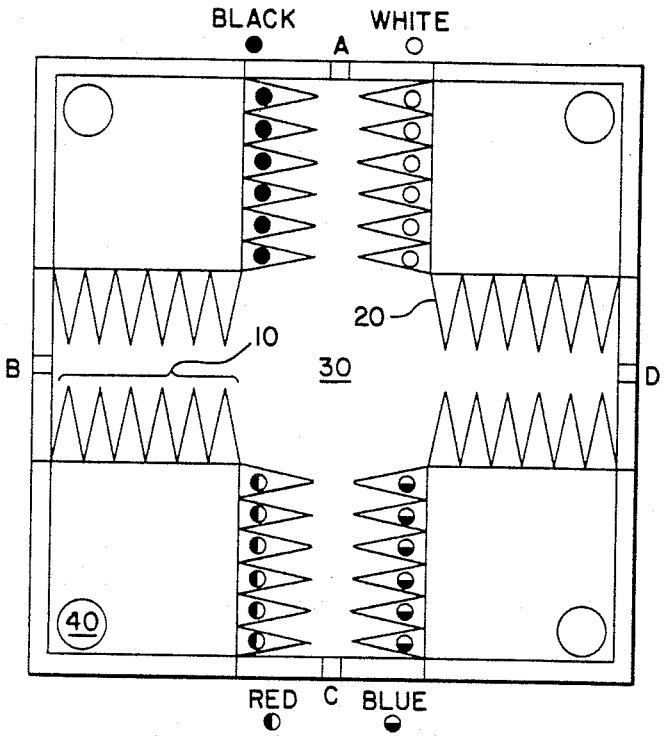
FIG. 3 shows the game board as in FIG. 1 with the stones positioned for a third game variation referred to herein as Piggy Back TM game.

FIG. 3 shows the game board with the stones prepositioned in the players' inner table for a third game variation, the game Piggyback. Only six stones are used for each player, with the six stones one each on the six points 20 of the player's inner table. Each stone may be moved independently around the entire board to exit at the player's outer table. Stones may be stacked two to six high and then moved as a stack around the board. A stack of stones is moved as a single stone the number of spots on one die. Stacks thus move the stones around the board faster, but they are not protected from being hit by an opposing player. Only stacks two stones high are safe from being hit. When single or, stacks of three or more, stones are hit they must go to the platform 30 and re-enter at the inner table of the player, one at a time. A player may bear off their stones immediately after circling the board.

Referring to FIG. 3, as per the above rules, the various color stones are moved around the board through the segments 10 of each leg of the cross, sequentially, as follows:

Black: A-B-C-D-A (Counterclockwise);
White: A-D-C-B-A (Clockwise);
Red: C-B-A-D-C (Clockwise);
Blue: C-D-A-B-C (Counterclockwise).

It should also be noted that the inner table for black is the outer table for white, and visa versa. Similarly, the inner table for red is the outer table for blue, and visa versa. The balance of the rules are the same as for the Ultragammon game.

Figure 4:
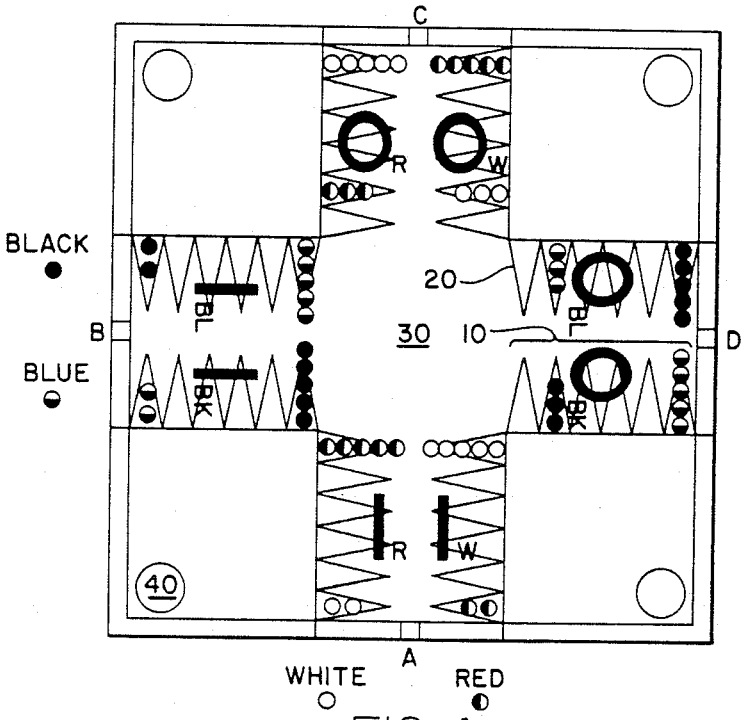
FIG. 4 shows the game board as in FIG. 1 with the stones positioned for a fourth game variation referred to as Ultracross TM game.

FIG. 4 shows the game board with the stones prepositioned for a fourth game variation, the Ultracross game. This game is played exactly as conventional backgammon with the players sitting directly opposite each other. White's opponent is the red player, and black's opponent is the blue player. The only exception to conventional backgammon in this variation is that the roll of the dice is done in turn by each player moving in a clockwise direction between competing and non-competing players alike. A subvariation of the fourth variation is the conventional game of two player backgammon. In either version, each player moves his stones only around the twenty-four points 20 in the A-C or B-D arms of the cross, respectively.

For example, white moves from red's inner table ($I_r$), to red's outer table ($O_r$), to white's outer table ($O_w$), to white's inner table ($I_w$), as in conventional backgammon. Red moves in the opposite direction to white. Similarly, black moves from blue's inner table ($I_{bl}$), to blue's outer table ($O_{bl}$), to black's outer table ($O_{bk}$), to black's inner table ($I_{bk}$). Blue moves in the opposite direction to black.

Figure 5:
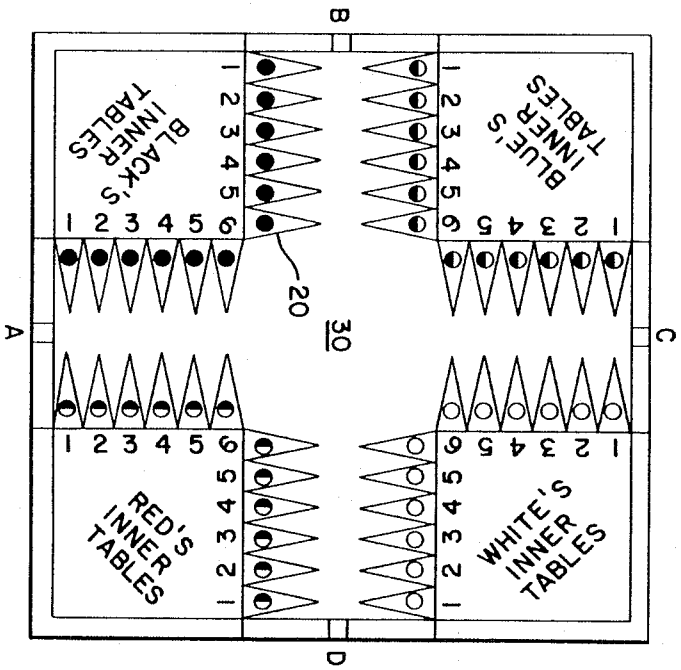
FIG. 5 shows the game board as in FIG. 1 with the stones positioned for a fifth game variation referred to herein as Ultra Wars TM game.

FIG. 5 shows the game board with the stones positioned for a fifth game variation, the Ultra Wars game. The object of this game is for the player to move their stones from their inner table to the inner tables of the opponents, knocking the opponents stones onto the platform 30. Each player in turn moving clockwise rolls their dice, and moves their stones from a numbered point 20 in their inner table that corresponds with the number of spots on a die to either one of the two adjacent opponent's inner table points 20 having a stone and the same number designation (see FIG. 5). A second stone can be moved similarly based on the number of spots shown on the second die rolled. For example, if the red player rolls 6/3, they may move a stone from their 3 point on cross leg D to white's 3 point on cross leg D, and a stone from their 6 point on cross leg A to black's 6 point on cross leg A. Alternately, both moves may have been made against white or both against black. The hit stones of either move combination are placed on platform 30 and are thus out of play. In the game of Ultra Wars the hit stones are not re-entered and there cannot be more than one stone on any one point 20.

If a player rolls a double, they have the option of moving any four stones from-to similarly numbered points of any of their three opponents in any combination corresponding to the number of spots on one die. Roll of a double always entitles the player to another roll without any limit on the permissible number of doubles which they may roll in a row.

If the player has not rolled a double and neither the player nor either of their adjacent opponents have stones on the numbered points corresponding to the number of spots showing on dice, the turn passes to the next player.

A player may hit their own stones on an opponent's inner table. The first player to move his last stone from his inner table to an opponent's inner table is the winner. To score the game of Ultra Wars the winner gets zero points, while each of the other players are awarded a number of points equal to the number of stones on platform 30 of their color multiplied by 10, and that result then multiplied by the number of stones remaining in their inner table.

While the invention has been illustrated and described in its preferred embodiment, it should be understood that the invention is not to be limited to the precise details illustrated herein and described above since the same may be carried out in other ways falling within the scope of the invention as illustrated and described.

We claim:

1. A game apparatus for playing backgammon like games comprising:

a game board having:

four rectangular corner areas of the same size and shape each having two of its sides forming a portion of an edge of the game board, the length of the sides of each corner area being approximately one-third the total length of the corresponding edge of the game board with each corner area being devoid of any indicia which is essential to the playing of the game;

a first rectangular playing surface disposed between one and an opposite edge of the game board intermediate the corner areas on those edges;

a second rectangular playing surface disposed between the other two edges of the game board intermediate the corner areas on those edges; and a plurality of triangularly shaped game points extending into each rectangular playing surface from each juncture of the corner areas and the rectangular playing surfaces with the game points on the adjacent sides of the playing surface being aligned with each other;

said first and second rectangular playing surfaces crossing in the center of the game board, that central area being devoid of any indicia which is essential to the playing of the game;

sixty stones each of a different one of four different colors with fifteen stones of each of said four colors; and means for randomly selecting a number from a limited set of numbers, said selected number determining the play of one of said stones.

2. A game apparatus for playing backgammon like games comprising:

a game board having:

four rectangular corner areas of the same size and shape each having two of its sides forming a portion of an edge of the game board, the length of the sides of each corner area being approximately one-third the total length of the corresponding edge of the game board with each corner area being devoid of any indicia which is essential to the playing of the game;

a first rectangular playing surface disposed between one and an opposite edge of the game board intermediate the corner areas on those edges;

a second rectangular playing surface disposed between the other two edges of the game board intermediate the corner areas on those edges; and forty-eight triangularly shaped game points with six points extending into each rectangular playing surface from each juncture of the corner areas and the rectangular playing surfaces with the game points on the adjacent sides of the playing surface being aligned with each other;

said first and second rectangular playing surfaces crossing in the center of the game board, that central area being devoid of any indicia which is essential to the playing of the game;

sixty stones each of a different one of four different colors with fifteen stones of each of said four colors; and means for randomly selecting a number from a limited set of numbers, said selected number determining the play of one of said stones, wherein said random selection means is a pair of dice.

* * * * *